United States Patent [19]

Bartolini

[11] Patent Number: 4,673,448

[45] Date of Patent: Jun. 16, 1987

[54] SLIDER FOR RIBBON, PARTICULARLY FOR CLOTHING ARTICLES, PROCESS FOR ASSEMBLING THEREOF AND RELATIVE APPARATUS

[75] Inventor: Dario Bartolini, Impruneta, Italy

[73] Assignee: Lovable Industriale S.p.A., Grassobbio, Italy

[21] Appl. No.: 697,762

[22] Filed: Feb. 4, 1985

[30] Foreign Application Priority Data

| | | | |
|---|---|---|---|
| Feb. 2, 1984 | [IT] | Italy | 19431 A/84 |
| May 16, 1984 | [IT] | Italy | 20960 A/84 |
| Nov. 30, 1984 | [IT] | Italy | 23823 A/84 |

[51] Int. Cl.[4] ..... A44B 11/28; B29C 65/08

[52] U.S. Cl. ..... 156/73.1; 24/90 HA; 24/200; 24/265 R; 156/212; 156/226; 156/256; 156/443; 156/556; 156/580.1

[58] Field of Search ..... 156/73.1, 73.2, 73.5, 156/212, 256, 443, 556, 580.1, 226; 24/90 HA, 186, 198, 200, 265 R; 223/49

[56] References Cited

U.S. PATENT DOCUMENTS

| | | | |
|---|---|---|---|
| 3,313,300 | 4/1967 | Mathison et al. | 24/186 |
| 4,315,351 | 2/1982 | Bartolini | 24/198 |
| 4,457,051 | 7/1984 | Bartolini | 24/198 |
| 4,529,463 | 7/1985 | Bartolini | 156/443 |

FOREIGN PATENT DOCUMENTS

| | | |
|---|---|---|
| 0123117 | 10/1984 | European Pat. Off. . |
| 2409711 | 6/1979 | France . |
| 2394259 | 8/1983 | France . |

*Primary Examiner*—Michael Wityshyn
*Attorney, Agent, or Firm*—Young & Thompson

[57] ABSTRACT

A two-slotted slider for ribbons comprises a bridge section between the slots, formed by two aligned arms, there being on the arms a fastening area for the ribbon generally provided with tapered reliefs for ultrasonic welding. Preferably the slider is assembled with the ribbon by first pushing both an intermediate loop portion of the ribbon and an end of the latter to pass beyond the elastically flexible arms, and then welding the said ribbon end onto the fastening area of the arms, which is facing the ribbon loop.

Welding is carried out between a sonotrode and a contrast device. The apparatus comprises the retractable contrast device and a housing for receiving the sliders one by one and displacing them between a position under a pusher for pushing the ribbon and a position under the sonotrode, as well as a device for straightening the ribbon.

7 Claims, 21 Drawing Figures

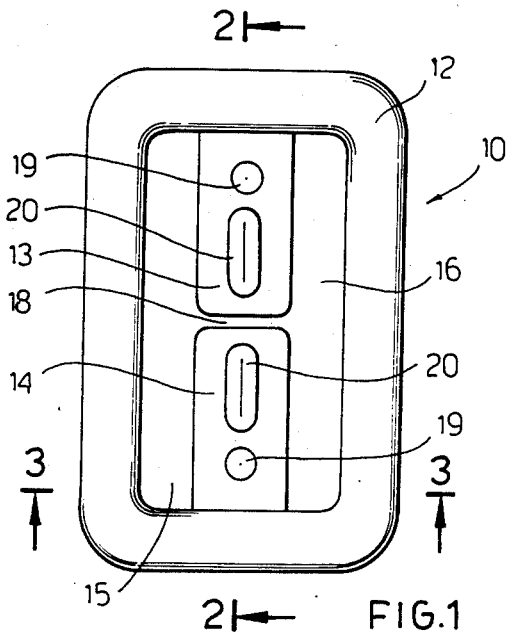
FIG.1
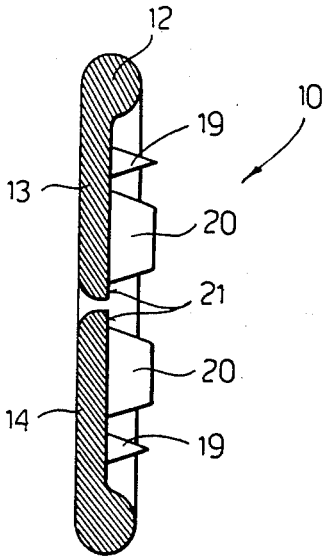
FIG. 2
FIG. 3
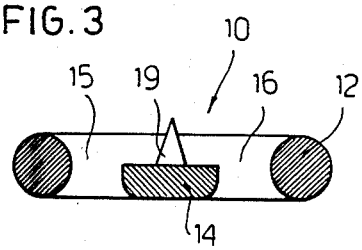
FIG. 1A
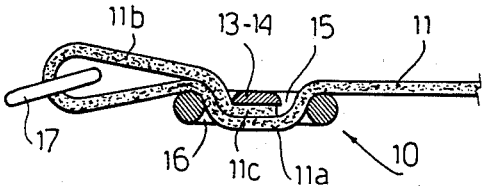
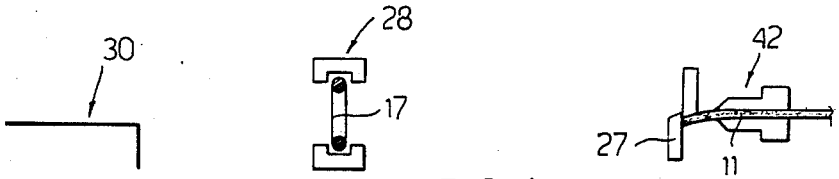
FIG. 4
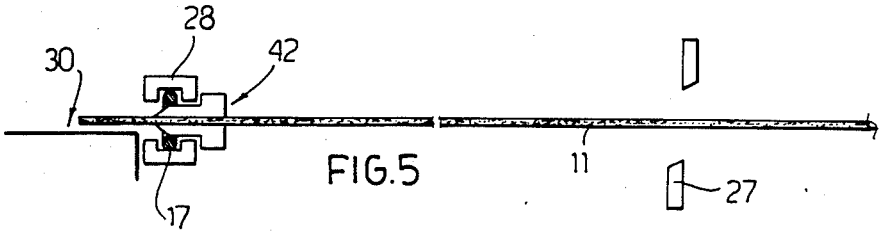
FIG.5

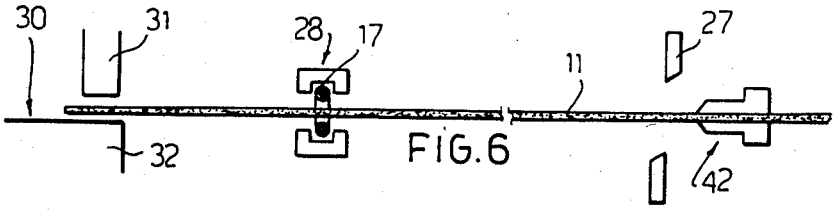
FIG.6
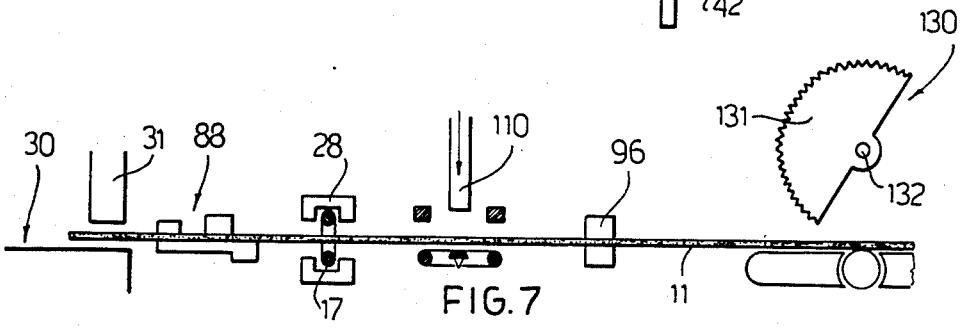
FIG.7
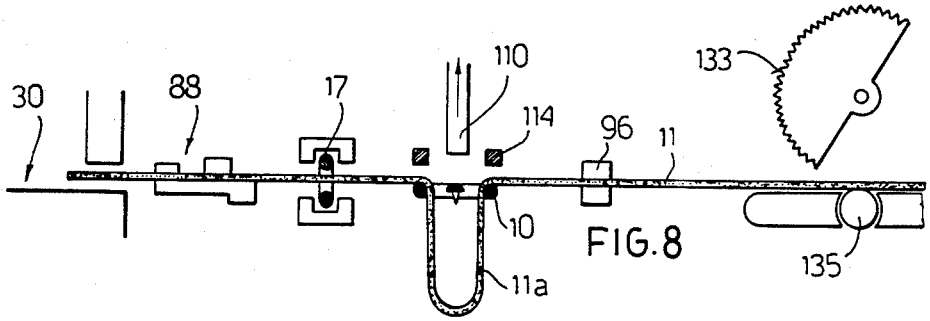
FIG.8
FIG.9
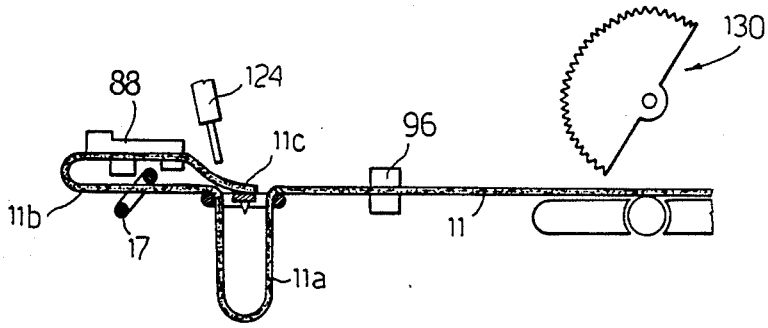
FIG.10
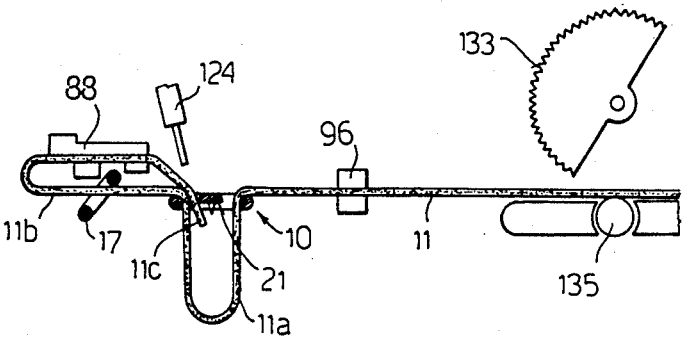

FIG. 11
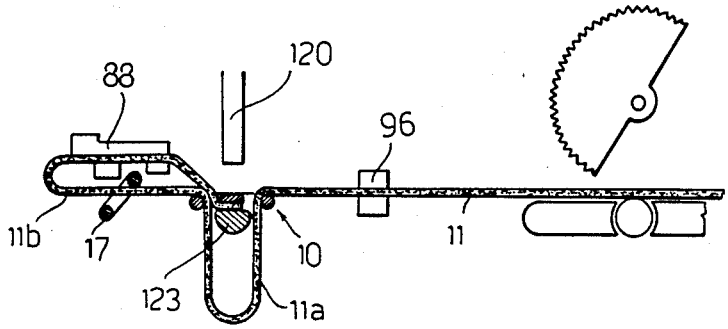
FIG. 12
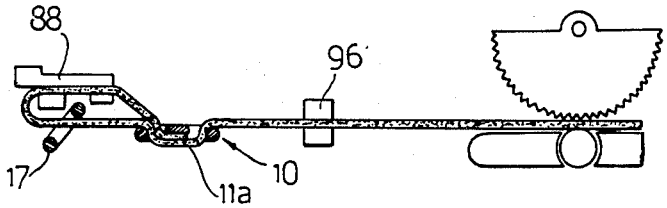
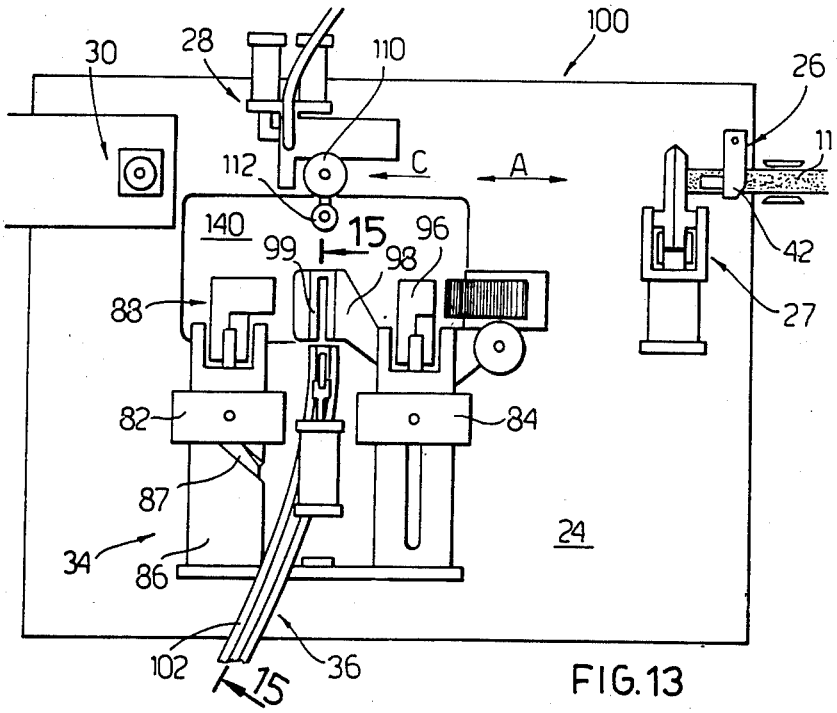
FIG. 13

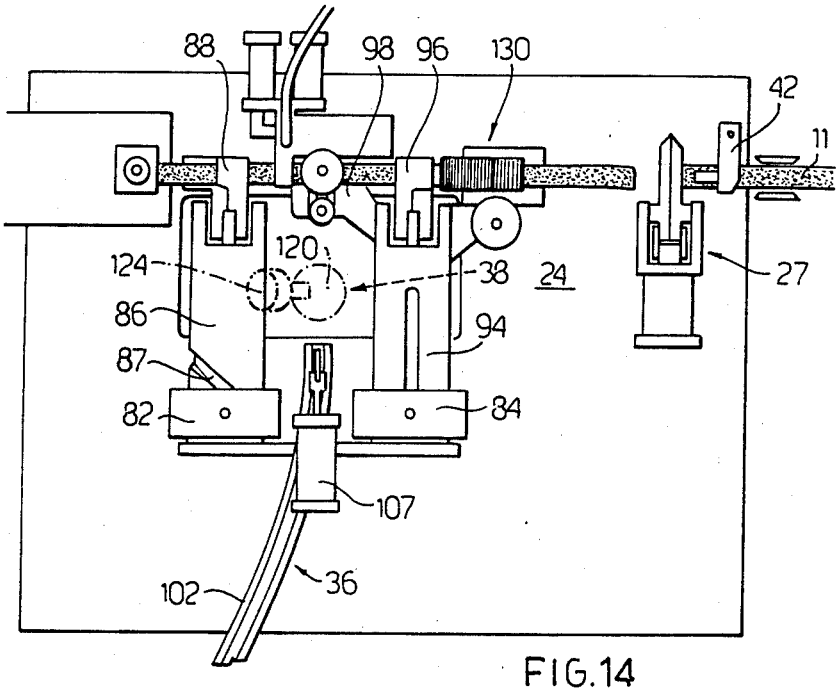
FIG.14
FIG.17
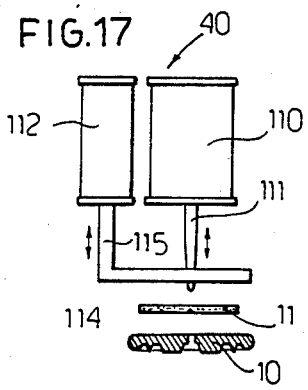
FIG.15
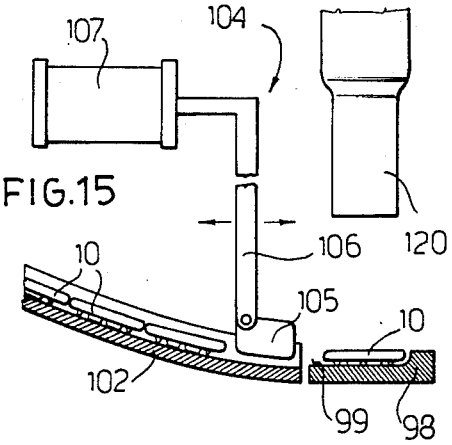
FIG.16
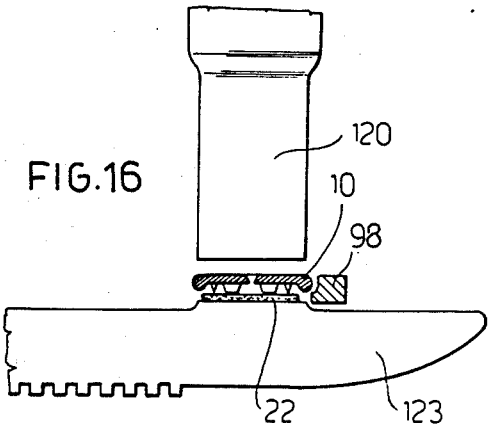
FIG.18
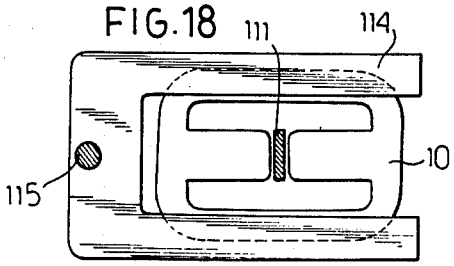

SLIDER FOR RIBBON, PARTICULARLY FOR CLOTHING ARTICLES, PROCESS FOR ASSEMBLING THEREOF AND RELATIVE APPARATUS

This patent application refers to the field of sliders for ribbons and clothing articles, as used for example on elastic or non-elastic ribbons in shoulder-straps for underwear articles to allow adjustment of their length. In the form known at present, such sliders comprise a body with two parallel slots, separated by a bridge section. A conventional type of ribbon-slider unit comprises an elastic or non-elastic ribbon, a slider with two slots separated by a bridge section and a ring. The ribbon has a loose end for attaching to the clothing article; the other end is sewn or welded to the slider; a middle section of the ribbon is inserted into both slots in the slider so as to be astride the bridge section; and between said welded end and said middle section the ribbon forms a noose for holding the ring or similar object.

A conventional shoulder-strap assembling process comprises the manual operation of fastening the ribbon end to the bridge section by sewing, inserting the ribbon first into the slider ring opening and then into both slots. This is a relatively long, laborious and also expensive process, as it involves the use of labour.

Previous patents from the same applicant, U.S. Pat. No. 4,315,351, U.S. Pat. No. 4,457,051 and FR Pat. No. 2,394,259 show a special type of two-slot slider, in which the bridge section is formed by two aligned arms arranged end to end and a slider fastening area is provided for fastening the ribbon at the side of one slot. The arms are flexible and assembling is carried out by ultrasonically welding one end of the ribbon onto the fastening area and then, using a punch or pusher, pushing an intermediate section or portion of the ribbon through the arms. The pusher deforms the arms temporarily and then retracts leaving the ribbon in a loop astride said arms. Although the prior type of slider has performed satisfactorily and considerably reduced the costs of producing shoulder-straps for underwear acticles, nevertheless it has some drawbacks. In fact, if the shoulder-strap is not correctly handled, the ribbon may slip out of the position astride the arms. In addition, since the arrangement of the ribbon relative to the slider is slightly different than in conventional sliders, users may be confused when trying to adjust the length of the shouldler-strap.

Previous patent FR Pat. No. 2,409,711 shows a ribbon-slider unit, or adjustable ribbon, comprising a two-slot slider with bridge section, in which the bridge section is composed of a single brace onto which the ribbon end is welded. However, with this type of ribbon-slider unit the ribbon must always be inserted manually or automatically into the slider, which is a slow and expensive process. In addition, there are drawbacks in having the welding on the external side of the bridge section, that is, the side facing the intermediate section of the ribbon astride the bridge.

One object of this invention is to make possible completely automatic assembly of sliders and ribbons to form adjustable ribbons or slider-ribbon units.

Another object is to realize slider-ribbon units which are tough and aesthetically pleasing.

In order to realize the above-mentioned objects a new slider has been designed which is the type comprising a body and a bridge section with two slots, through which the ribbon slides, said bridge section comprising two aligned arms placed end to end and separated by a gap, and characterized in that said arms have an area to which the ribbon is attached or fastened. According to a further characteristic, the arms of the new slider have tapered reliefs which serve as energy lines for ultrasonic welding.

A preferred process for assembling the slider comprises inserting a part of the ribbon beyond the arms using a punch or pusher, in such a way that the ribbon forms a loop beyond said arms, and then welding the end of the ribbon folded back onto the arms or bridge part of the slider, so that said arms are made integral with one another. It is preferable to carry out ultrasonic welding with the ribbon arms placed between a sonotrode (device for carrying out ultrasonic welding) and a positioning and contrast means, the latter placed between the side of the arms facing the sonotrode and the loop section of the ribbon astride said arms.

Preferably according to the process provision is made for arranging the ribbon end to be welded, as well as an intermediate ribbon section or portion, beyond the arms in the bridge section of the slider, and for welding the end onto the side of the arms facing the loop portion of the ribbon inserted in the slots and astride the arms, in order to avoid pulling stresses and welding burrs on the outer part of the slider or parts in contact with the skin.

The end of the ribbon may be set beyond the arms either by the same pusher operation which pushes the ribbon loop beyond the arms or by a subsequent operation with a blade which inserts said end into one of the slots. The positioning and contrast means, therefore, is inserted between the ribbon loop and the ribbon end to be welded and brings the latter against the side of the bridge section facing the loop, whereas the welding means (generally a sonotrode) is placed against the other side of the bridge section.

In this way a ribbon-slider unit is obtained comprising a said slider and a ribbon, the ribbon being arranged with a loop portion beyond the arms and a section folded back, one of the ribbon ends being welded to the slider's bridge section at a position between said bridge section and the loop portion.

An apparatus for assembling the above-said slider, for forming the above-said ribbon-slider units, comprises an advancing unit for advancing the ribbon made up of a pliers member moving basically along the ribbon's longitudinal axis; a slider-feeding unit; a welding unit for welding the ribbon to the slider, comprising a welding means; a unit for traversing and turning over the ribbon, comprising at least one gripper which can be extended and retracted and rotating on its own axis when passing from one condition to the other; and a unit for inserting the ribbon into the slider, comprising a punch or pusher. The slider-feeding unit ends at a position alongside said gripper in the traversing and turning over unit, when the gripper is retracted. The apparatus comprises a housing to receive the sliders one at a time, which also extends and retracts with said gripper. The apparatus also comprises a contrast means which moves between an extended position, in which it projects under said housing in the retracted position, and a retracted position, in which it does not project under said housing.

The apparatus may also comprise a second gripper, integral with the first, which moves between an extended and retracted position. The second gripper holds said housing for the slider integral with it and also holds, integral with it, a means for straightening the ribbon, generally composed of an arc-shaped surface engaging one side of the ribbon and an idle roller against the other side.

The slider, process and apparatus which are the subject of this patent have the advantage of fully automating the production of ribbon-slider units with a considerable reduction in costs.

The resulting ribbon-slider unit is very tough, aesthetically pleasing—even more than conventional units—and has no or almost no protruding or excessively thick parts, which might not make it completely comfortable to wear. One end of the ribbon is fastened in a position between the slots and the welding of an end of the ribbon onto the arms helps to make the arms integral with one another, so that when the ribbon is pulled to adjust the length it does not cause the arms to open and said ribbon to slip out.

An embodiment of the invention preferred at present is described below with reference to the accompanying drawings in which:

FIG. 1 is a plan view of the slider, according to the invention;

FIG. 1*a* is a longitudinal sectional view along a ribbon-slider unit;

FIG. 2 is a sectional view along 2—2 in FIG. 1;

FIG. 3 is a sectional view along 3—3 in FIG. 1;

FIGS. 4, 5, 6, 7, 8, 9, 10, 11 and 12 show various consecutive stages in the process for making the ribbon-slider unit, presented very schematically;

FIGS. 13 and 14 are plan views of the apparatus at separate stages of the process;

FIG. 15 is a sectional view along 15—15 in FIG. 13;

FIG. 16 is a sectional view along 16—16 in FIG. 19;

FIG. 17 is a partial schematic front elevation along arrow C in FIG. 13;

FIG. 18 is a top view of a slider-stopping foot, drawn enlarged compared to FIG. 15;

Figure 19:
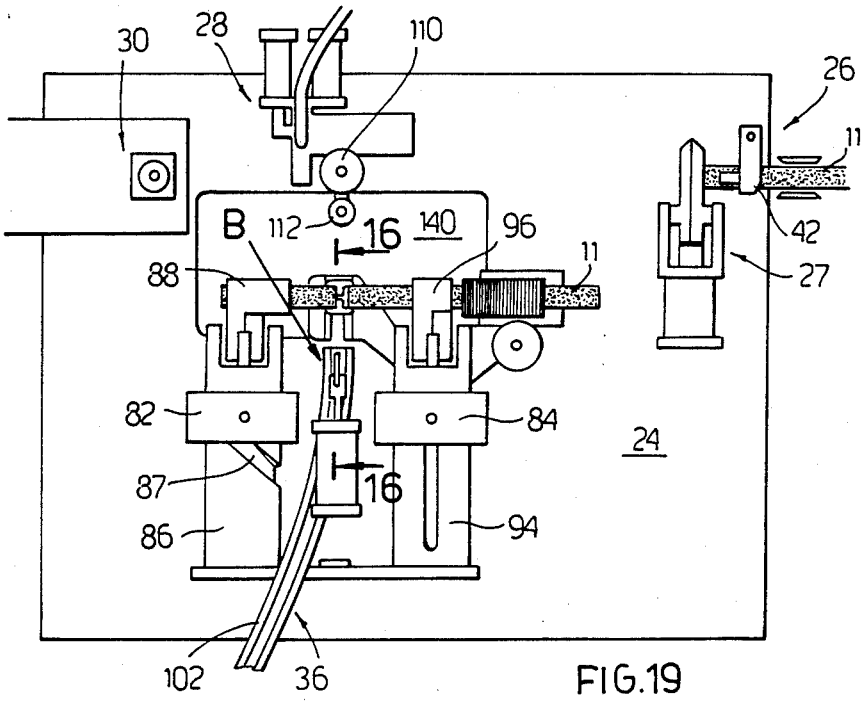
FIG. 19 is a view, similar to that in FIGS. 13 and 14, of the apparatus shown in the position of FIG. 10.
Figure 20:
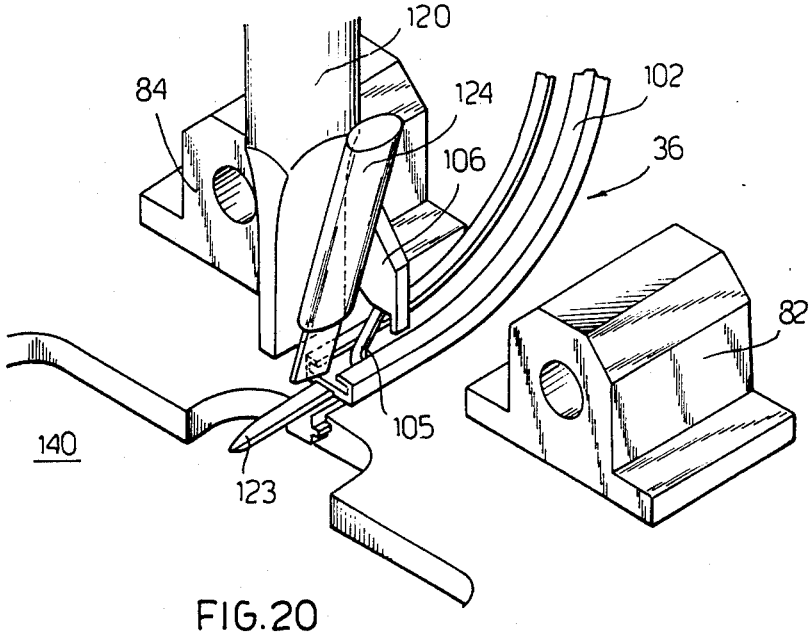
FIG. 20 is a perspective view with parts removed along arrow B in FIG. 19.

The new slider, globally indicated with 10 in the figures, comprises a body 12 and a bridge section composed of two aligned arms 13, 14 which form, together with the body, two parallel slots 15, 16.

In the example shown the body, seen in a plan view, is basically rectangular in shape with rounded edges and, seen in a sectional view, basically circular. However, this is not binding on the invention.

The arms 13 and 14, arranged aligned end to end, are separated by a gap 18 and have a preferably flattened shape, seen in a sectional view, so that they may have an elastic flexibility. On one side the arms 13 and 14 have tapered reliefs 19 and 20 of a type suitable for forming energy lines for ultrasonic welding. If provision is made for welding the ribbon on the "outer" side of the slider arms, the reliefs 20 nearest to the facing ends of arms 13 and 14 have an elongated shape along the longitudinal axis of said arms to facilitate sliding the ribbon through and beyond them.

Obviously, the reliefs may be more or less in number and arranged differently than as shown.

In this way a fastening section or area 21 is defined on arms 13, 14 for fastening the ribbon to the slider.

A ribbon-slider unit according to this patent application is shown in FIG. 1*a*. The ribbon 11, shown by broken lines, passes through the slot 15, forms a loop at 11*a* astride the arms 13, 14 and passes through the slot 16; it extends into a noose at 11*b* engaging a ring 17; and finally the ribbon end 11*c* is fastened to arms 13, 14 which are made integral with one another. It is preferable for the ribbon end to be arranged between the bridge section of the slider formed by arms 13, 14 and the ribbon loop 11*a*, (i.e. welded to the "inner" side of the slider arms). However, a different arrangement is also possible.

The assembly process will now be described with reference to FIGS. 4 to 12.

An apparatus 100 (FIG. 13) for making shoulder-straps comprises, mounted on a frame with work table, an advancing unit 26 for advancing the ribbon, scissors or cutting unit 27, a ring-feeding unit 28 (these elements are not described in detail, as they are already known from a previous European patent application, publication number 0123117 A1), a holding means 30 for holding the ribbon, a unit 34 for traveling and turning over the ribbon, a unit 36 for feeding the sliders, a welding unit 38 (FIG. 14) and a unit 40 for inserting the ribbon into the slider (FIG. 17).

The unit for advancing the ribbon, in a known way, feeds ribbon 11 for shoulder-straps from, for example, a continuous reel and comprises a pliers member 42 which moves between one end position beyond the scissors 27 and the other end position near the holding means.

The holding means 30, placed at the end of travel of pliers 42, may be of any kind known in the field, for example another pliers member, or preferably a rod 31 (FIGS. 6–7) which can be lowered onto an anvil 32.

The unit for traversing and turning over the ribbon comprises two blocks 82, 84 fixed onto the work table 24. The body 86 of a traverse gripper 88 runs inside block 82 from an extended position (shown in FIG. 14) to a retracted position (shown in FIG. 13) and viceversa. At least a part of the body 86 has a helical chanel 87 for engaging with a fixed pin (not shown) protruding into block 82, so that, when the body 86 passes from the extended position (FIG. 14) to the retracted position (FIG. 13) and viceversa, it also rotates on its own axis by about 180°. The gripper 88 comprises two basically flat jaws suitable for placing in contact with both side of ribbon 11. Any known type of mechanism may be used for opening and closing the jaws.

The body 94 of a second traverse gripper 96 runs inside block 84. This body 94 moves, integral with body 86, between an extended position (FIG. 14) and a retracted position (FIG. 13). Opening and closing of the jaws is operated by any known means. Integral with the body 94 is a "flag-like" extended support plate 98, said plate having a U-shaped through housing 99 with sunken edges, the function of which will be described later on.

The unit 36 for feeding the sliders comprises a feeding device, for example a vibrating feeder, not shown because already known, and a slanting channel 102, whose end furthest from the feeder finishes at a position intermediate between the two blocks 82 and 84. A holding device 104 (FIG. 14) works in conjunction with the slanting channel 102 and comprises an oscillating foot 105, held by an angled rod 106 of a cylinder-piston unit 107. The foot is moved forwards and backwards at distances equal to the size of the slider. At each forward and backward movement a slider is released into the housing 99.

The unit 40 for inserting the ribbon comprises a cylinder-piston means 110, whose rod 111 (FIG. 17) acts as a punch or pusher to insert the ribbon into the slider by deforming the arms of said slider. Integral with the means 110 is a holding means 112, comprising a fork-shaped foot 114 (FIG. 18), integral with the cylinder-piston rod 115, for holding the slider on withdrawal of the pusher 111.

The welding unit comprises a welding means, for example, a sonotrode 120 arranged, as in FIG. 14, vertically across the housing 99, when the latter is in the retracted position. In addition, it comprises a contrast means 123 which moves between a retracted position fully under the supply end of channel 102 and an extended position, in which it extends beyond said end. The contrast means 123 may be moved in any known way, for example, by means of a pinion and rack coupling. Provision may be made near the sonotrode for a blade device 124 to insert the ribbon end into the slider, if the welding is to be covered by the intermediate portion of the ribbon.

Provision is made for a straightening device 130 to straighten the ribbon and remove the loop formed by the pusher for inserting the ribbon. This device 130 comprises a member 131 which rotates on a basically horizontal axis 132, said member having a knurled or, in any case, rough arc-shaped surface 133 and working in conjunction with an idle roller 135 with a basically horizontal axis, placed in line with the side of the ribbon not facing the surface 133. The surface 133 straightens the ribbon by being moved anticlockwise. The device 130 is preferably held by the body 94 of gripper 96.

We will next proceed to describe the assembly process.

The end of a continuous ribbon 11 (previously cut at the front end using a scissors device 27) is first seized in the gripper 42, which closes and holds it fast (FIG. 4; FIG. 13). A ring 17 is fed from unit 28 and, in general, deformed temporarily, making use of its elasticity. The temporary deformation of the ring increases its width sufficiently to enable the ribbon 11 to be easily inserted. Obviously, in the case of a sufficiently large rectangular ring, the ring will not be deformed in advance; the grippers 88 and 96 are in the retracted position (FIG. 13).

The forward movement of the pliers member unit 42 begins with the scissors device 27 open. The pliers member 42 holds the end of ribbon 11 horizontal with a part of said ribbon protruding, passes between the blades of the open scissors 27, moves to the left in the figures and then meets unit 28, where it inserts the end of ribbon 11 into a ring 17. Next said member 42 continues its forward movement, to the left in the figures, together with unit 28, until the ribbon end is placed in the holding member 30 above the anvil 32 (FIG. 5). The pressing rod 31 is lowered and blocks the ribbon end (FIG. 6).

The grippers 88 and 96 move forward into the extended position (FIG. 14). The housing 99 holds a prepositioned slider 10. The grippers seize the ribbon 11 at the points between units 30 and 28 and units 28 and 27 respectively. The housing 99 with the slider is placed under an intermediate portion or section of the ribbon. The pusher 111 is lowered and inserts the ribbon 11 into the slider 10 by deforming its arms. Then said pusher is raised (FIG. 8), leaving a ribbon loop 11*a* beyond the slider. During raising the slider is held by the foot 114.

The grippers 88 and 96 are moved into the retracted position (FIG. 19) together with the ribbon, slider and ring. At the same time gripper 88 rotates through 180° on the axis of its own body 86, bending the ribbon 11 into a noose 11*b* and bringing the ribbon end 11*c* above the slider and vertically in line with the intermediate loop portion 11*a* of ribbon 11, inserted into the slider (FIG. 9). The ring 17 remains inserted in the noose 11*b*. When the grippers are in the retracted position, the housing 99 with section 11*a* of ribbon 11 inserted in the slider is in a vertical position under the sonotrode 120. The blade member 124, placed above the ribbon near the sonotrode, inserts end 11*c* of the ribbon into the slot nearest the slider. Alternatively, folding the ribbon into a noose may precede the pusher operation and said pusher may insert the ribbon loop 11*a* and its end 11*c* beyond the slider arms at the same time. The contrast means 123 is brought into the extended position between loop 11*a* (FIG. 11) and under the end of the ribbon. The sonotrode is lowered to weld the ribbon end onto the slider arms, without including the loop 11*a* in the welding. The arms with the ribbon welded to them in this way are now integral with one another. Then the sonotrode is raised and the contrast means retracted.

The device 130 begins to function by rotating the surface 133 in order to pull out the loop 11*a*. The grippers 88 and 96 open and an ejector (not shown) ejects the formed ribbon-slider unit, for example causing it to drop through an opening 140.

What I claim is:

1. A process for assembling a slider and a ribbon in order to obtain a slider-ribbon unit with adjustable length, the slider being a two-slot type having a bridge section between the slots formed by two elastically flexible arms and a fastening area for fastening to the ribbon; said process comprising the steps of inserting an intermediate portion of the ribbon length into the slots and beyond the arms, by elastically deforming the arms, and leaving said intermediate portion beyond the arms in a loop when the arms spring back, then welding one end of the ribbon folded back in a loop onto the slider and pulling out the ribbon loop against the slider, the fastening area of the slider being located on said deformable arms, whereby said arms are linked together by the ribbon welded thereto.

2. A process according to claim 1, in which the welding is carried out ultrasonically using a sonotrode, wherein during welding a contrast means is placed on the opposite side of the arms relative to the sonotrode.

3. A process according to claim 1, wherein said slider is arranged with the fastening area facing the loop portion of the ribbon and said ribbon end to be welded is arranged inside the loop portion of the ribbon, between the loop portion of the ribbon and the slider.

4. A process according to claim 3, and using a blade means to insert said ribbon end in one of the slider's slots and into the loop.

5. A process according to claim 3, and using a pusher to insert said ribbon end inside the loop at the same time as the ribbon loop is inserted beyond the arms.

6. A process according to claim 3, further comprising inserting in the loop portion between the loop and end of the ribbon a means of support and contrast, such as to push said end against the slider's fastening area and keep it in this position during welding.

7. A process according to claim 1, and straightening the ribbon which is inserted astride the slider's arms, by pulling it in the direction of its longitudinal axis.

* * * * *